US011103419B2

(12) United States Patent
Won et al.

(10) Patent No.: US 11,103,419 B2
(45) Date of Patent: Aug. 31, 2021

(54) DISPLAY DEVICE

(71) Applicant: Korea Institute of Industrial Technology, Chungcheongnam-do (KR)

(72) Inventors: Byeong Hee Won, Yongin-Si (KR); Jong Hyun Kim, Chungcheongnam-do (KR); Woo Sang Sim, Gwangmyeong-Si (KR)

(73) Assignee: KOREA INSTITUTE OF INDUSTRIAL TECHNOLOGY, Chungcheongnam-Do (KR)

( * ) Notice: Subject to any disclaimer, the term of this patent is extended or adjusted under 35 U.S.C. 154(b) by 801 days.

(21) Appl. No.: 15/301,059

(22) PCT Filed: Jan. 16, 2015

(86) PCT No.: PCT/KR2015/000482
§ 371 (c)(1),
(2) Date: Sep. 30, 2016

(87) PCT Pub. No.: WO2015/152506
PCT Pub. Date: Oct. 8, 2015

(65) Prior Publication Data

US 2017/0027814 A1 Feb. 2, 2017

(30) Foreign Application Priority Data

Apr. 1, 2014 (KR) ..... 10-2014-0038420

(51) Int. Cl.
*A61H 23/00* (2006.01)
*A61H 23/04* (2006.01)
(Continued)

(52) U.S. Cl.
CPC ..... *A61H 23/04* (2013.01); *A61H 1/006* (2013.01); *A61H 9/005* (2013.01); *A61H 9/0078* (2013.01);
(Continued)

(58) Field of Classification Search
CPC ..... A61H 9/005; A61H 9/0078
See application file for complete search history.

(56) References Cited

U.S. PATENT DOCUMENTS 6,027,444 A * 2/2000 Franck ..... A61H 23/0254 310/36
8,147,435 B2 * 4/2012 Ferber ..... A61H 7/004 601/134
(Continued)

FOREIGN PATENT DOCUMENTS

JP 2005342340 A 12/2005
JP 2014506521 A 3/2014
(Continued)

OTHER PUBLICATIONS

International Search Report (and English translation) and Written Opinion dated Mar. 31, 2015 in International Application No. PCT/KR2015/000482.

*Primary Examiner* — LaToya M Louis
(74) *Attorney, Agent, or Firm* — Cantor Colburn LLP

(57) ABSTRACT

A display device includes a cover part, a driving unit for transmitting an external force to the human body through the cover part, and a display unit that is provided at a position of the cover part through which the external force is transmitted to the human body, and indicates a display in accordance with the external force transmitted from the driving unit.

8 Claims, 18 Drawing Sheets

(51) Int. Cl.
*A61H 9/00* (2006.01)
*A61H 1/00* (2006.01)

(52) U.S. Cl.
CPC ..... *A61H 2201/0146* (2013.01); *A61H 2201/0149* (2013.01); *A61H 2201/0188* (2013.01); *A61H 2201/5043* (2013.01)

(56) References Cited

U.S. PATENT DOCUMENTS

| | | | | |
|---|---|---|---|---|
| 8,784,345 | B2 * | 7/2014 | Peddicord | A61H 19/00 601/46 |
| 2001/0052153 | A1 * | 12/2001 | Schwartz | A47C 7/725 5/905 |
| 2002/0145512 | A1 * | 10/2002 | Sleichter, III | B60N 2/56 340/407.1 |
| 2009/0176635 | A1 * | 7/2009 | Brinson | A61H 7/001 482/141 |
| 2016/0046028 | A1 * | 2/2016 | Meier | A46B 5/0062 30/41 |

FOREIGN PATENT DOCUMENTS

| | | | |
|---|---|---|---|
| KR | 20120036238 | A | 4/2012 |
| KR | 20140036677 | A | 3/2014 |

* cited by examiner

[Fig. 8]
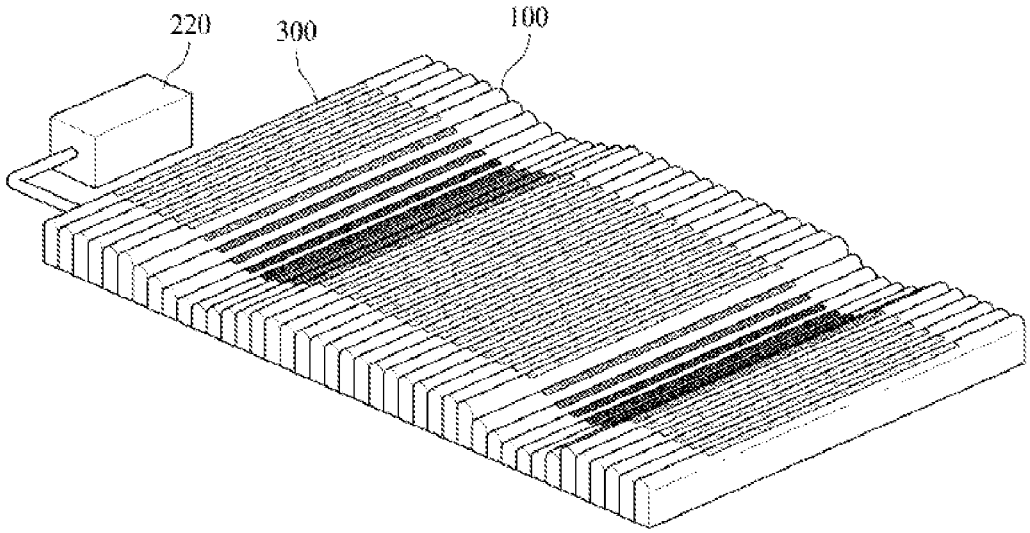
[Fig. 9]
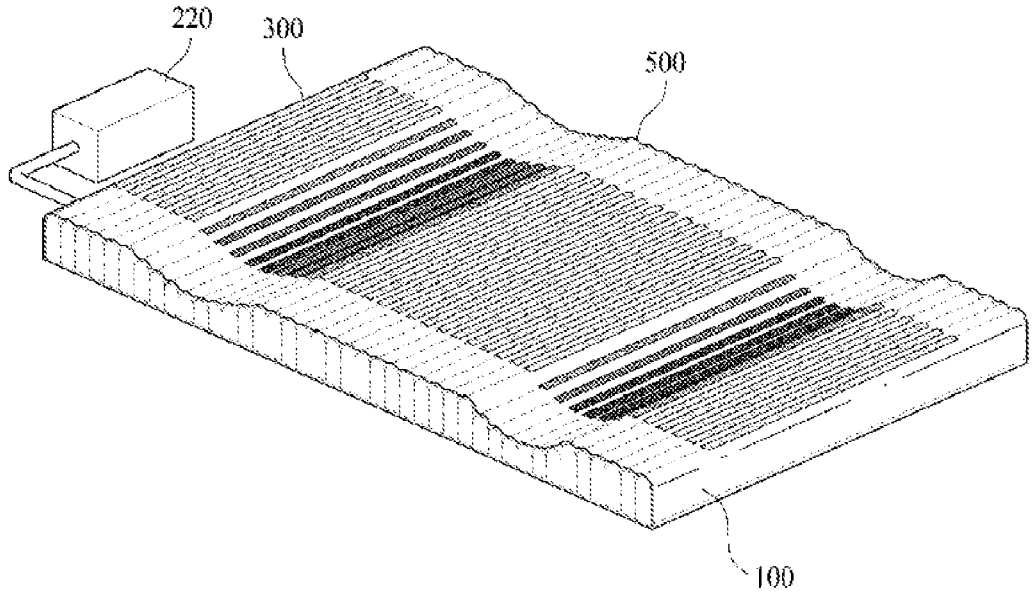

DISPLAY DEVICE

CROSS-REFERENCE TO RELATED APPLICATION

This application is a Section 371 of International Application No. PCT/KR/2015/000482, filed Jan. 16, 2015, which was published in the Korean language on Oct. 8, 2015 under International Publication No. WO 2015/152506 A1, and the disclosure of which is incorporated herein by reference.

TECHNICAL FIELD

The present invention relates to a display device, and more particularly, to a display device that allows a user to recognize intensity of an external force transmitted to a human body from a target relied on and used by the user with high visibility.

BACKGROUND ART

Generally, for the purpose of prevention of bedsore or massage, mats, chairs and the like for transmitting the external force to the user's body have been widely used.

Such mats and chairs intended for prevention of bedsores or massage transmit the external force to the user's body through vibration, physical movement or the like, and in many cases, the mats and chairs transmit the external force on the human body, while changing in a variety of intensities, rather than transmitting a continuous external force at a constant intensity.

At this time, in order that the user checks at which mode the mats and chairs intended for the prevention of bedsores or massage are operating among various modes, he/she needs to check it using a separate display, causing inconvenience.

In addition, even if the mode is checked by a separate display, in many cases, it is difficult to clearly to understand that the currently running mode is a mode which indicates accurately which kind of movement, and in many cases, in order to check this, there is a need to check another manual.

Furthermore, there is a problem that there may be a case required to directly experience, feel and check for the correct checking of the running mode.

DISCLOSURE

Technical Problem

An object of the present invention is to solve the problems mentioned in the background art and to provide a display device that allows a user to recognize intensity of an external force transmitted to a human body from a target relied on and used by the user, with high visibility.

The object of the present invention is not limited to aforementioned mentioned object, and other objects that have not been mentioned will be clearly understood by a person who has ordinary knowledge in the art to which this invention pertains, from the following description.

Technical Solution

According to an aspect of the present invention, there may be provided a display device that includes a cover part; a driving unit for transmitting an external force to the human body through the cover part; and a display unit that is provided in contact with the cover part, and indicates a display in accordance with the external force transmitted from the driving unit.

Here, the driving unit may be provided as a vibrating unit that generates vibration to be transmitted to the human body through the cover part.

Further, the cover part may be formed with spaces partitioned into a plurality of pieces inside the cover part, and the driving unit may be provided as a pump that injects fluid into the plurality of partitioned spaces to transmit the external force to the human body.

At this time, the display device may further include another cover that encloses the cover part in which the space is partitioned, and the display unit may be provided in contact with the cover.

Meanwhile, the display unit may include a plurality of light-emitting sections, and may express different light-emitting forms in accordance with the intensity of the external force transmitted by the driving unit.

Further, the display unit may measure the intensity of the external force transmitted by the driving unit and indicate a display corresponding to the intensity of the measured external force.

Further, the display unit may share a signal for adjusting the intensity of the external force provided to the driving unit and indicate a display corresponding to the intensity of the external force.

Further, a plurality of driving units and a plurality of display units may be provided, respectively.

Further, the display unit may be a planar light-emitting body.

Advantageous Effects

According to the display device according to the present invention, there is an effect of allowing a user to recognize intensity of an external force transmitted to a human body from a target relied on and used by the user with high visibility, without using a separate display.

In particular, since a mat or a chair for the purpose of prevention of bedsores or massaging is generally driven in various modes, there is an effect that is capable of relatively quickly and easily grasping the driving state of the mat or the chair, without the need to check the separate driving states.

Effects of the present invention are not limited to the aforementioned effects, and other effects that have not been mentioned will be clearly understood from the scope of the claims to those skilled in the art.

DESCRIPTION OF DRAWINGS

FIG. 8 is a diagram illustrating a second embodiment in which the driving unit is provided as a pump.

FIG. 9 is a diagram illustrating a configuration in which the second embodiment of FIG. 8 further includes a cover.

BEST MODE

Figure 1:
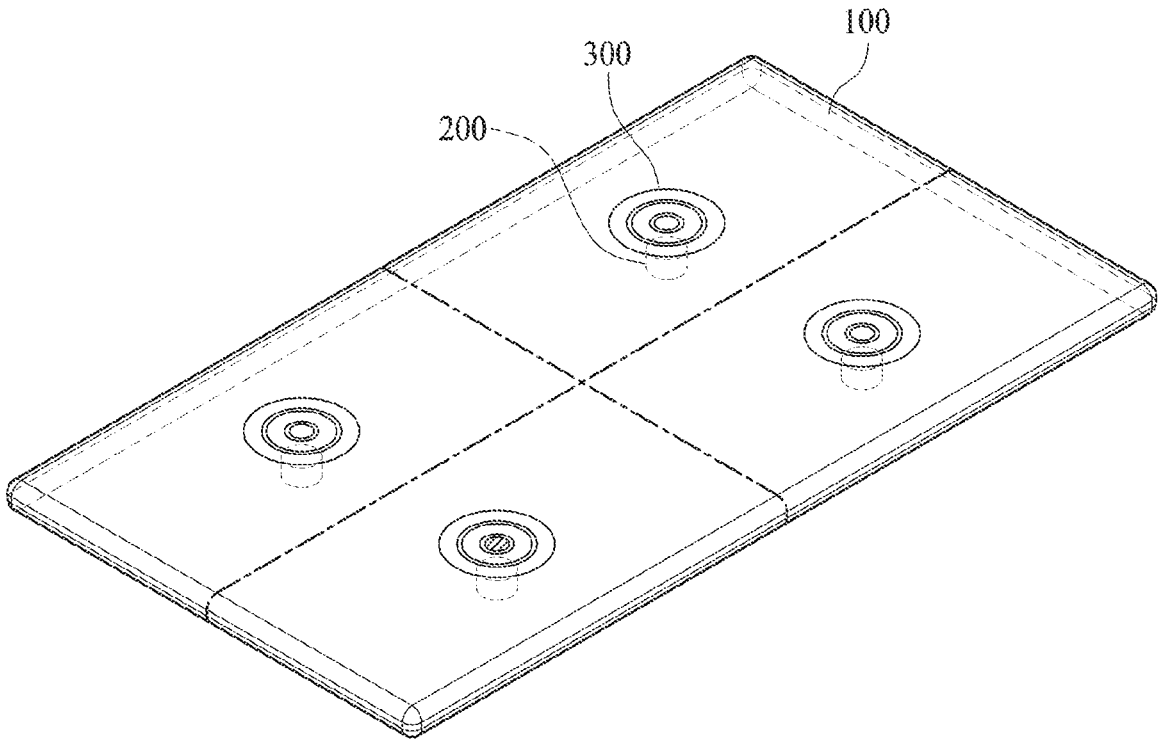
FIG. 1 is a diagram illustrating an overall configuration of a first embodiment of a display device according to the present invention.

Hereinafter, embodiments of the invention will be described in detail with reference to the accompanying drawings. The drawings are attached hereto to help explain exemplary embodiments of the invention, and the present invention is not limited to the drawings and embodiments. In the drawings, some elements may be exaggerated, reduced in size, or omitted for clarity or conciseness.

In addition, in describing the present invention, the terms indicating the directions such as "front and rear" or "upside and downside" are described so that those skilled in the art can clearly understand of the present invention, and indicate the relative direction. Thus, the scope of the invention is not limited thereby.

First Embodiment

First, a first embodiment of a display device according to the present invention will be explained in detail referring to FIGS. 1 to 7.

Figure 2:
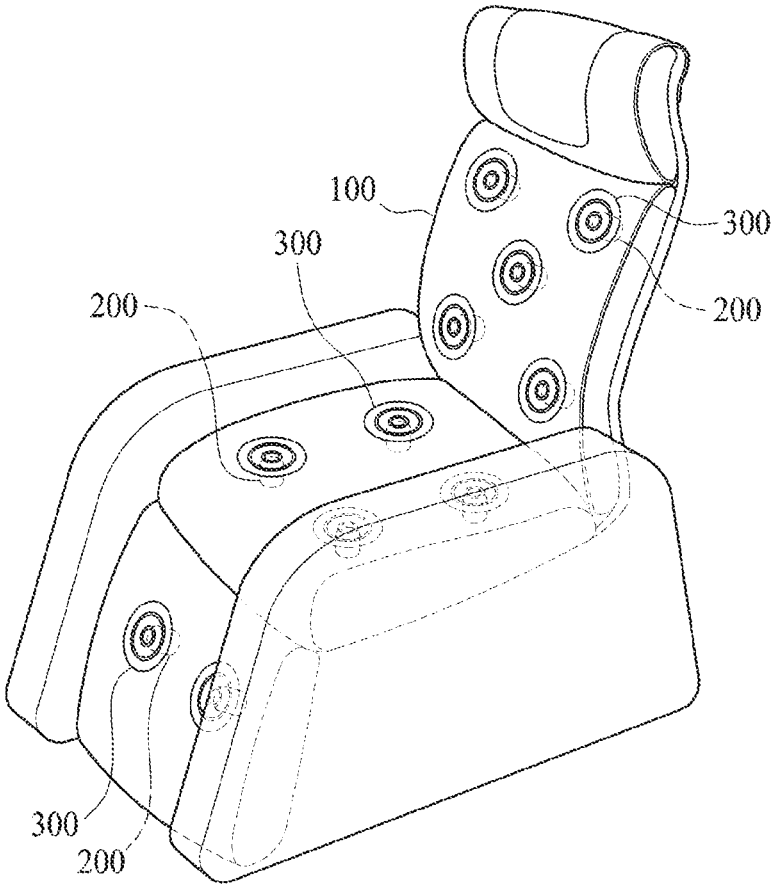
FIG. 2 is a diagram illustrating a configuration in which the first embodiment of the display device according to the present invention is applied to a massage chair.

Here, FIG. 1 is a diagram illustrating an overall configuration of a first embodiment of a display device according to the present invention, and FIG. 2 is a diagram illustrating a configuration in which the first embodiment of the display device according to the present invention is applied to a massage chair.

Meanwhile, FIGS. 3A to 3F are diagrams illustrating an example in which the display unit displays a display corresponding to the intensity of the external force transferred from the driving unit, and FIGS. 4A to 4F are diagrams illustrating another example in which the display unit displays a display corresponding to the intensity of the external force transferred from the driving unit.

Figure 5:
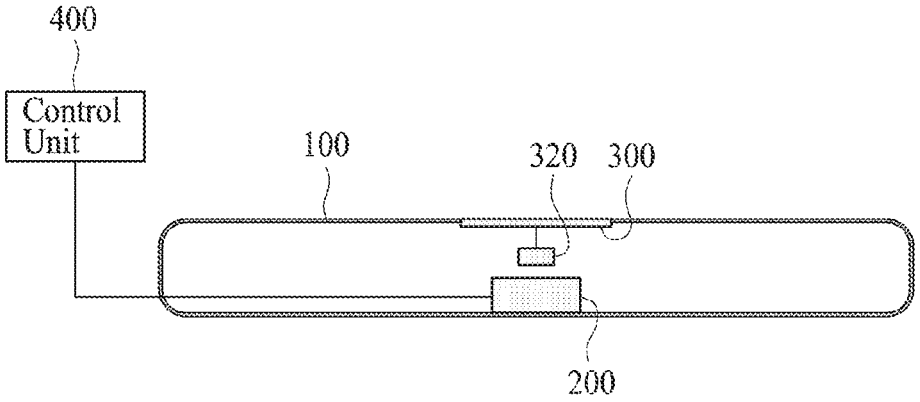
FIG. 5 is a diagram illustrating a configuration in which the display unit detects the intensity of the external force transferred from driving unit.
Figure 6:
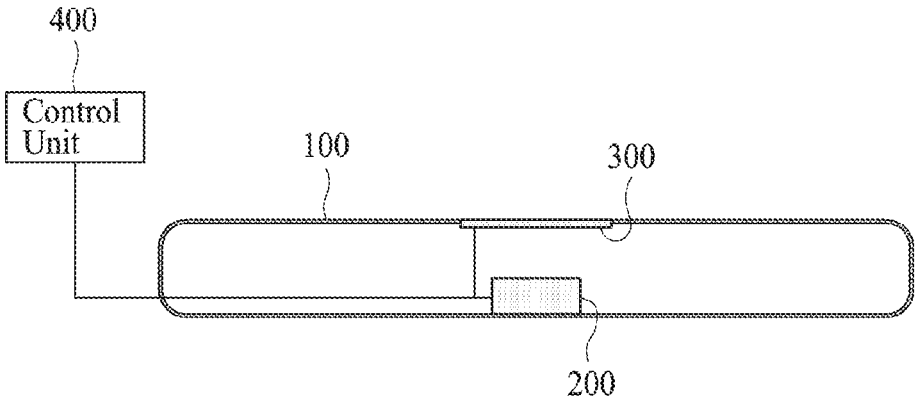
FIG. 6 is a diagram illustrating the configuration in which the display unit shares the signal transmitted to driving unit.
Figure 7:
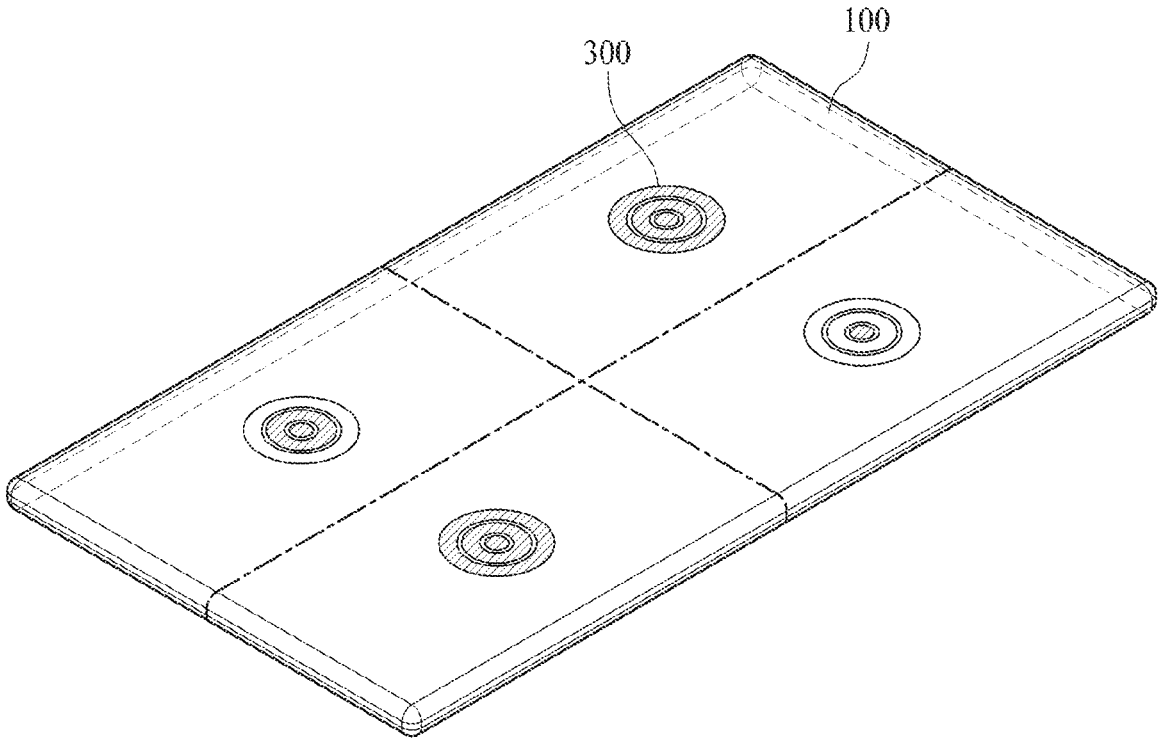
FIG. 7 is a diagram illustrating a configuration in which a plurality of driving units and a plurality of display units are provided.

FIG. 5 is a diagram illustrating a configuration in which the display unit detects the intensity of the external force transferred from driving unit, FIG. 6 is a diagram illustrating the configuration in which the display unit shares the signal transmitted to driving unit, and FIG. 7 is a diagram illustrating a configuration in which a plurality of driving units and a plurality of display units are provided.

As illustrated in FIGS. 1 and 2, the first embodiment of a display device according to the present invention may include a cover part 100, a driving unit 200 and a display unit 300.

The cover part 100 as a component that is in contact with the human body and has a predetermined area may be configured to include an upper surface which is in contact with the user's body in a vibration mat or a vibration chair in this embodiment.

As long as such cover part 100 is provided to be able to support the user's body, its shape and configuration may vary without limitation.

Meanwhile, the driving unit 200 is a component for transmitting the external force to the user's body through the cover part 100, and in this embodiment, the driving unit may be provided with a vibration unit 210 that is disposed on the opposite side on which the cover part 100 supports the human body on the basis of the cover part 100 to generate vibration.

Here, the vibration unit 210 is a component that generates the vibration and transmits the vibration to the human body via the cover part 100, and may be applied to a mat or a chair for prevention of bedsores and massage, and in this embodiment, there is a configuration in which a vibration unit 210 is provided in the vibration mat or the vibration chair.

As long as the vibration unit 210 is provided so as to be able to generate vibrations of various intensities that are suitable for massage or prevention of bedsores and to transmit the vibrations to the human body, its shape and structure may be varied without limitation.

Meanwhile, the display unit 300 is a component that is provided in contact with the cover part 100 and displays a display in accordance with the external force transmitted from the driving unit 200, and in this embodiment, the display unit 300 may be provided as a plurality of light-emitting sections 310.

The display unit 300 is provided on the upper surface of the cover part 100, and is advantageously provided at the position of the cover part 100 through which the external force generated by the driving unit 200 is transmitted to the human body such that the driving condition of the driving unit 200 can be clearly illustrated.

Further, if the display unit 300 is provided on the upper surface of the cover part 100, the display unit 300 is advantageously provided as the planar light-emitting body in order to enhance the user's convenience.

Alternatively, a part of the cover part 100 of site in which the cover part 100 and the display unit 300 are coupled to each other is formed to allow light to transmit therethrough, and the display unit 300 may be provided on the back side of a site through which light of the cover part 100 can transmit.

As illustrated in FIGS. 1 to 4, in such a display unit 300, the light-emitting section 310 of the display unit 300 displays different forms in accordance with the intensity of the external force generated by the driving unit 200, and in this embodiment, a plurality of display units 300 may be provided to include a first light-emitting section 311, a second light-emitting section 312 and a third light-emitting section 313.

Further, in the present embodiment, the display unit 300 is provided with the light-emitting section 310, the first light-emitting section 311 is formed in a circular shape, the second light-emitting section 312 is formed in a ring shape that encloses the first light-emitting section 311, and the third light-emitting unit 313 is formed in a ring shape that encloses the second light-emitting section 312. Thus, the display unit may be provided by being generally disposed in the form of concentric circles.

However, when the light-emitting section 310 provided as a single piece is provided in order to display the intensity of the external force generated by the driving unit 200, such as displaying the intensity of the vibration through the brightness, its shapes and configurations may be varied without limitation.

Such a display unit 300 displays the intensity of the external force generated by the driving unit 200 in a variety of ways. With reference to FIGS. 3A to 4F, when the vibration unit 210 to which the present embodiment is applied generates vibrations of varying intensities, it is possible to know that light-emitting section 310 expresses the light-emitting forms in which each vibration is different for each intensity.

Figure 3A:
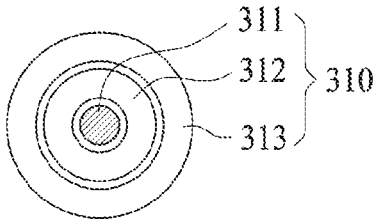
FIGS. 3A to 3F are diagrams illustrating an example in which the display unit displays a display corresponding to the intensity of the external force transferred from the driving unit.
Figure 3B:
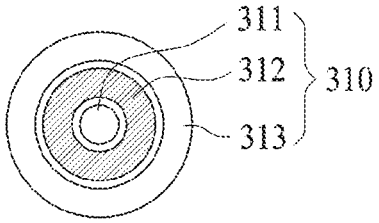
Figure 3C:
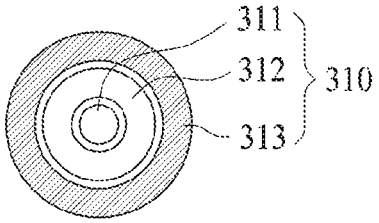
Figure 3D:
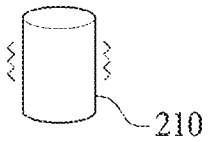
Figure 3E:
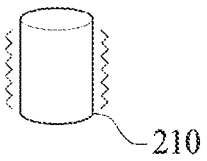
Figure 3F:
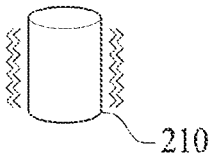

First, as illustrated in FIGS. 3A to 3F, the light-emitting section 310 different for intensity of each vibration emits the light and as a result the corresponding light-emitting section may display the intensity of the corresponding vibration generated by the vibration unit 210. More particularly, it is possible to display the intensity of vibration generated by the vibration unit 210 in a manner that when the vibration unit 210 generates a vibration of relatively low intensity (FIG. 3D), only the first light-emitting section 311 among the entire light emitting-sections 310 emits the light (FIG. 3A), when generating the vibration of stronger intensity (FIG. 3E), only the second light-emitting section 312 among the entire light-emitting sections 310 emits light (FIG. 3B), and when generating the strongest vibrations (FIG. 3F), only the third light-emitting unit 313 among the entire light-emitting section 310 emits light (FIG. 3C).

Alternatively, as illustrated in FIGS. 4A to 4F, in the light-emitting section 310, the light-emitting sections 310 of the different numbers may emit light for intensity of each vibration to display intensity of vibration generated by the vibration unit 210.

Figure 4A:
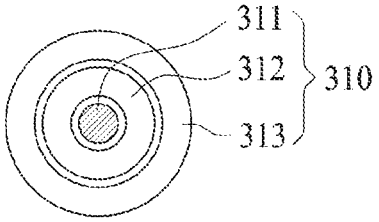
FIGS. 4A to 4F are diagrams illustrating another example in which the display unit displays a display corresponding to the intensity of the external force transferred from the driving unit.
Figure 4B:
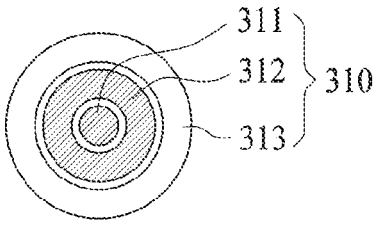
Figure 4C:
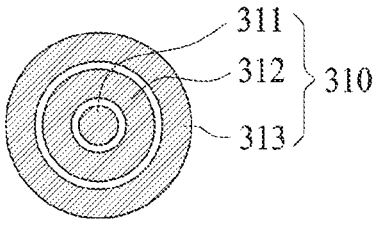
Figure 4D:
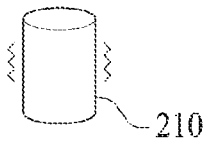
Figure 4E:
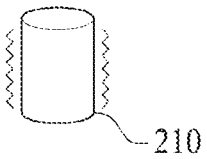
Figure 4F:
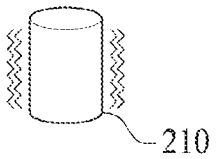

More particularly, it is also possible to display the intensity of vibration generated by the vibration unit 210 in a manner that, when the vibration unit 210 generates a vibration of relatively low intensity (FIG. 4D), only the first light-emitting section 311 among the entire light emitting-sections 310 emit light (FIG. 4A), when generating the vibration of stronger intensity (FIG. 4E), the first light-emitting section 311 and the second light-emitting unit 312 among the entire light-emitting sections 310 emit light (FIG. 4B), and when generating the strongest vibration (FIG. 4F), all of the first light-emitting section 311, the second light-emitting section 312 and the third light-emitting unit 313 emit light (FIG. 4C).

The representation of the aforementioned display unit 300 is only an example applied to the present embodiment, and if it is possible to express the intensity of the external force generated by the driving unit 200, various representation methods may be applied.

Meanwhile, a method of grasping intensity of the external force generated by the driving unit 200 through the display unit 300 is as follows.

As illustrated in FIG. 5, the display unit 300 may further include an external force intensity detecting sensor 320.

In this case, the driving unit 200 receives the signal from the control unit 400 for controlling the driving unit 200 to generate an external force to be transmitted to the human body, the external force intensity detecting sensor 320 of the display unit 300 measures the intensity of the external force to be generated by the driving unit 200, and the display unit 300 may determine to express which type of display in accordance with intensity of the external force detected by the external force detecting sensor 320.

As long as such an external force intensity detecting sensor 320 is provided to measure the intensity of the external force to be generated by the driving unit 200, its shape and configuration may be varied without limitation.

Alternatively, as illustrated in FIG. 6, the display unit 300 may display the intensity of the external force generated by the driving unit 200, by sharing the signal for the external force intensity adjustment supplied to the driving unit 200.

In such a case, when the driving unit 200 receives a signal from the control unit 400 which controls the driving unit 200 to generate an external force to be transmitted to the human body, the display unit 300 shares the signal supplied to the driving unit 200 from the control unit 400 to determine that the display unit 300 express which type of display in accordance with the information on intensity of the signal.

Meanwhile, as illustrated in FIGS. 1, 2 and 7, a plurality of driving units 200 and a plurality of display units 300 may be provided.

At this time, the driving units 200 and the display units 300 are provided in the same number to each other, and the display unit 300 is advantageously provided to correspond to the position where the driving units 200 is provided.

Through such an arrangement, when each driving unit 200 is driven by different driving conditions, it is possible to easily grasp the driving condition of the driving unit 200.

In the present embodiment, the arrangement of the driving unit 200 and the display unit 300 is only an embodiment, and the arrangement can be variously applied.

With such a configuration, the plurality of driving units 200 can generate an external force of different intensities, and the display units 300 corresponding to the respective driving units 200 may display the intensity of the external force to be generated by each driving unit 200, accordingly.

That is, as illustrated in FIG. 7, there is an effect that the states differently driven for each site in accordance with the user's intended use are displayed through the display unit 300 provided in each site, and a user can intuitively determine the driving state of the vibration mat or the vibration chair with high visibility.

Second Embodiment

Subsequently, a second embodiment of a display device according to the present invention will be explained in detail with reference to FIGS. 8 and 9.

Here, FIG. 8 is a diagram illustrating a second embodiment in which the driving unit is provided as a pump, and FIG. 9 is a diagram illustrating a configuration in which the second embodiment of FIG. 8 further includes a cover.

As illustrated in FIG. 8, a second embodiment of the display device according to the present invention includes a cover part 100 and a display unit 300, and another pump 220 is provided as the driving unit 200.

The cover part 100 has a configuration similar to the cover part 100 of the first embodiment of the display device according to the present invention described above, but a plurality of partitioned spaces are formed inside the cover part 100.

In the present embodiment, although the space is partitioned in the form in which a number of tubes having a predetermined length are connected with each other, if the internal space of the cover part 100 is partitioned without communicating with each other, its shape and configuration may be varied without limitation.

Meanwhile, the pump 220 is a component that can supply or remove liquid to the each space partitioned inside the cover part 100, and unlike the case where an external force is the vibration in the first embodiment described above, in the present embodiment, the partitioned spaces of the cover part 100 swells, while the fluid is supplied to the partitioned spaces of the cover part 100 by the pump 220, and the force by which the swelling cover part 100 supports the human body becomes the external force transmitted to the human body.

That is, the pump 220 supplies or removes the fluid to the internal space of the partitioned cover part 100, the height of the upper surface of the cover part 100 changes, and when the cover part 100 supports the human body part of the user located on the top surface of the cover part 100, accordingly, it is possible to obtain the effect of the prevention of bedsore or massage, while the external force applied to the specific site of the human body changes.

Further, it is possible to variously apply the pattern, in which the pump 220 supplies or removes the fluid to the inside of the cover part 100 to apply an external force to the human body of the user, without being limited.

Meanwhile, the display unit 300 is formed in the configuration similar to the first embodiment described above.

In the present embodiment, a number of display unit 300 is provided in the cover part 100, and each display unit 300 is configured so that a single light-emitting section express the brightness, without having a plurality of light-emitting sections, but the expression method may be various as in the display unit 300 of the first embodiment described above without being limited.

Further, in the present embodiment, it is possible to provide a configuration so that the display unit 300 displays the status information by checking the extent to which the fluid partitioned inside the cover part 100 is removed by the pump 220.

With such a configuration, there is also an effect in that the states differently driven for each site in accordance with the user's intended use are displayed through the display unit 300 provided in each site, and a user can intuitively determine the driving state of the vibration mat or the vibration chair with high visibility.

Meanwhile, as illustrated in FIG. 9, the second embodiment of the display device according to the present invention may further include another cover 500 that encloses the cover part 100 described above.

In this case, the display unit 300 can be advantageously provided in the cover 500, or it is also applicable that the cover 500 is formed to have high transmittance of light.

By using another cover 500, there is an effect capable of preventing a problem that may be caused by unevenness of the upper surface that may be formed while the internal space of the cover part 100 is partitioned, for example, problems from aspects of maintenance such as s failure that may be caused by foreign matters entering between the respective partitioned spaces or health problems, or a problem that the use's convenience is relatively lowered.

That is, there is an effect capable of relatively quickly and easily grasping various modes in which the device for transmitting an external force to the human body of users to drive for the prevention of bedsores and massage, while enhancing the user's convenience.

Further, as described above, while specific embodiments of the present invention have been described and illustrated, it is obvious to those skilled in the art that the present invention can be variously modified, without departing from the spirit and scope of the present invention, rather than being limited to the described embodiments. Accordingly, such modifications and variations should not be understood individually from the spirit and aspect of the present invention, and the modified examples should fall within the scope of the following claims.

The invention claimed is:

1. A display device comprising: a cover part;

at least three physical force generators, each configured to transmit an external force to a human body through the cover part; and at least three light emitters, the number of which is the same as the number of the physical force generators, wherein the physical force generators are paired with the light emitters, respectively, by one-to-one manner such that no two of the physical force generators are commonly paired with a same one of the light emitters, wherein each one of the light emitters is provided in a form of concentric circles, and each of the light emitters is provided at a portion of the cover part through which the external force is transmitted to the human body, and indicates a display in accordance with the external force transmitted from the paired physical force generator.

2. The display device according to claim 1, wherein each of the physical force generators is provided as a vibration generator that generates vibration to be transmitted to the human body through the cover part.

3. The display device according to claim 1, wherein the cover part is formed with spaces partitioned into a plurality of pieces inside the cover part, and the physical force generators includes a pump that injects fluid into the plurality of partitioned spaces to transmit the external force to the human body.

4. The display device according to claim 3, wherein the display device further comprises another cover that encloses the cover part in which the space is partitioned, and the light emitter is provided in contact with the cover.

5. The display device according to claim 1, wherein each of the light emitters includes a plurality of light-emitting sections, and expresses different light-emitting forms in accordance with the intensity of the external force transmitted by the paired physical force generator.

6. The display device according to claim 1, wherein the light emitter measures the intensity of the external force transmitted by the paired physical force generator and indicates a display corresponding to the intensity of the measured external force.

7. The display device according to claim 1, wherein the light emitter shares a signal for adjusting the intensity of the external force provided to the paired physical force generator and indicates a display corresponding to the intensity of the external force.

8. The display device according to claim 1, wherein the light emitter is a planar light-emitting body.

* * * * *